US007942856B2

(12) United States Patent
Lentini

(10) Patent No.: US 7,942,856 B2
(45) Date of Patent: May 17, 2011

(54) POST SURGICAL DRAIN FACILITATOR GOWN

(76) Inventor: Nedda Joy Lentini, Monterey, CA (US)

( * ) Notice: Subject to any disclaimer, the term of this patent is extended or adjusted under 35 U.S.C. 154(b) by 323 days.

(21) Appl. No.: 11/805,745

(22) Filed: May 24, 2007

(65) Prior Publication Data

US 2007/0271672 A1 Nov. 29, 2007

Related U.S. Application Data

(60) Provisional application No. 60/808,004, filed on May 25, 2006.

(51) Int. Cl.
*A61F 5/44* (2006.01)

(52) U.S. Cl. ..... 604/345; 2/247; 2/114; 2/248; 2/249; 2/250; 2/251; 2/252; 2/119; 2/120; 2/240; 2/312; 2/49.2; 2/49.5; 2/52; 2/100; 2/104; 2/105; 2/83; 2/94; 2/122; 2/124; 2/133; 2/117; 2/118; 2/134; 2/300; 2/320; 2/333; 2/243.1

(58) Field of Classification Search ..... 604/345; 2/247, 114, 248, 249, 250, 251, 252, 119, 2/120, 240, 312, 49.2, 49.5, 52, 100, 104, 2/105, 83, 94, 122, 124, 133, 117, 118, 134, 2/300, 320, 333, 243.1
See application file for complete search history.

(56) References Cited

U.S. PATENT DOCUMENTS 2,389,697 A * 11/1945 Stoeckert ..... 2/247
3,537,108 A * 11/1970 Daniels ..... 2/252
4,004,294 A * 1/1977 Pinch ..... 2/104
4,613,991 A * 9/1986 Grover ..... 2/23
4,718,124 A * 1/1988 Sawicki et al. ..... 2/114
4,924,613 A * 5/1990 Levin ..... 40/586
5,184,351 A * 2/1993 Benstock ..... 2/114
5,379,461 A * 1/1995 Wilmers ..... 2/115
5,429,593 A 7/1995 Matory
5,643,233 A 7/1997 Turner
5,652,962 A * 8/1997 Patnode ..... 2/114
(Continued)

OTHER PUBLICATIONS

Cancer Patient Designs Innovative Hospital Gown for Post-Surgical Drain Pouch.pdf (pp. 1-11), http://www.allbusiness.com/medicine-health/medical-treatments-procedures/13134817-1.html.*

(Continued)

*Primary Examiner* — Tatyana Zalukaeva
*Assistant Examiner* — Ginger T Chapman
(74) *Attorney, Agent, or Firm* — Patrick Reilly; Mona G. Gonzales

(57) ABSTRACT

A garment for securing and storing bodily fluid drainage reservoirs and other fluid reservoirs. The garment comprises a loose-fitting body with at least one small aperture for receiving drainage tubing and at least one pocket cloth partly fixed to the body of the garment and partly detachably coupled to the body of the garment which allows for the easy storage and removal of the fluid drainage reservoir. The pocket cloth allows for the continuing support of the drainage reservoir as the drainage reservoir becomes heavier e.g. about 1 kilogram, due to the collection of fluid draining from the patient into the drainage reservoir. The secure storage of the drainage reservoir enables the wearer to move without worry of the drainage reservoir coming loose, losing fluid, or being exposed to a non-sterile environment external to the pocket cloth. The garment may be configured for wear by male and female children and adults.

12 Claims, 4 Drawing Sheets

U.S. PATENT DOCUMENTS

| | | | | | |
|---|---|---|---|---|---|
| 5,689,829 | A | * | 11/1997 | Rose | 2/77 |
| 5,799,336 | A | * | 9/1998 | Cooper | 2/247 |
| 5,980,499 | A | | 11/1999 | Ekey | |
| 5,991,923 | A | * | 11/1999 | Maria | 2/83 |
| 6,032,289 | A | * | 3/2000 | Villapiano | 2/102 |
| 6,048,252 | A | * | 4/2000 | Sebring | 450/1 |
| 6,131,198 | A | * | 10/2000 | Westrick | 2/102 |
| 6,148,444 | A | * | 11/2000 | Holmes et al. | 2/69 |
| 6,397,398 | B1 | * | 6/2002 | Herder | 2/249 |
| 6,460,187 | B1 | * | 10/2002 | Siegel | 2/114 |
| 6,477,710 | B1 | * | 11/2002 | Ojoyeyi | 2/69 |
| 6,524,288 | B1 | | 2/2003 | Hadley-Fruit | |
| 6,574,800 | B1 | | 6/2003 | Leger | |
| 6,647,552 | B1 | * | 11/2003 | Hogan | 2/114 |
| 7,010,812 | B1 | | 3/2006 | Cho | |
| 7,073,204 | B1 | * | 7/2006 | Boyles | 2/114 |
| 7,293,295 | B2 | * | 11/2007 | King | 2/114 |
| 7,305,716 | B1 | * | 12/2007 | Richards | 2/114 |
| 7,396,272 | B1 | * | 7/2008 | Newlen | 450/54 |
| 7,418,741 | B2 | * | 9/2008 | Rogers | 2/114 |
| D584,882 | S | * | 1/2009 | Trouillot et al. | D2/720 |
| 2004/0226073 | A1 | * | 11/2004 | McCullar et al. | 2/114 |
| 2005/0235398 | A1 | * | 10/2005 | Yoo | 2/247 |
| 2010/0242150 | A1 | * | 9/2010 | Trouillot | 2/114 |

OTHER PUBLICATIONS

Sage Solutions_Available Gowns.pdf (pp. 1-2), http://www.sagesolutions.com/Products/Drain_Pouch_3.html Nov. 2, 2009 7:01:33 PM.*

Sage Solutions_Drain Pouch Management Gown Creation.pdf (pp. 1-2), http://www.sagesolutions.com/Products/Drain_Pouch_2.html Nov. 2, 2009 7:01:14 PM.*

Sage Solutions_Drain Pouch Management Gown.pdf (p. 1), http://www.sagesolutions.com/Products/Drain_Pouch.html Nov. 2, 2009 7:00:57 PM.*

Caring For Your Jackson Pratt Drainage System, Gross et al (7 pages). PDF document http://www.mskcc.org/patient_education/_assets/downloads-english/530.pdf.*

Jackson Pratt Wound Drainage Products, Brochure (15 pages) http://www.cardinalhealth.com/us/en/brands/medivac/files/JackPratt%20Brochure-Final%202004.pdf.*

Druckman, Cure for the Common Hospital Gown, O Magazine, Feb. 2007, p. 44, USA.

Triggs, Injection of Style, People Magazine, May 29, 2006, p. 115, USA.

"Pouch Pockets™ RecoveryWear," printed from website http:www.pouchpockets.com, having a date as early as Jan. 1, 2002.

"The Original Healing Threads™" printed from website http://www.spirited-sisters.com, having a date as early as Apr. 1, 2007.

* cited by examiner

POST SURGICAL DRAIN FACILITATOR GOWN

CO-PENDING APPLICATIONS

The present U.S. patent application is a continuation in part from U.S. Provisional Application No. 60/808,004 filed May 25, 2006.

BACKGROUND OF THE INVENTION

1. Field of the Invention

This invention relates generally to the field of post-surgical garments, and more particularly to a user wearable garment to be worn by a wearer who has undergone a medical procedure such as surgery, for example a mastectomy or axillary node dissection.

2. Description of the Related Art

A type of drainage device used in hospitals is a device that suctions and collects fluid from a post-surgical patient's surgery site. Drainage tubing is commonly inserted at surgery sites near the patient's underarm area, near the breast or near the patient's thigh area. The drain allows for the collection of fluid until the patient's body is able to reabsorb the fluid on its own. The drain also allows for the measurement of the amount of fluid draining from the patient's body, an important indicator as to whether the patient is hemorrhaging or experiencing a clot. For these reasons, health care professionals closely monitor the amount of fluid draining into a drain bulb.

The complete drainage reservoir assembly comprises drainage tubing which is inserted into the patient's surgery site at one end and is attached to a drainage bulb at the other end, allowing fluid to travel from the patient's body into the drainage bulb. A drainage assembly is often secured to a standard hospital gown by feeding the tubing through an opening of the gown and pinning the drainage reservoir bulb to the exterior portion of the gown. As the drainage bulb fills with fluid, it becomes heavier and harder to secure to a standard hospital gown. Often the weight of the drain drags the hospital gown downward, causing the ties securing the patient's gown to loosen or come undone. Also, the pin may detach from the gown causing the drain to come loose. This is extremely dangerous for a post-surgical patient for at least two reasons.

First, if the drainage reservoir assembly separates from the hospital gown the drainage reservoir bulb may drop on the ground and become exposed to a non-sterile environment. Exposure of the drainage reservoir assembly to a non-sterile environment may lead to infection in the patient. This is especially true for a patient who has just experienced surgery and has an open surgical site.

Second, fluid may spill from the drainage reservoir bulb so that the patient's healthcare provider is unable to monitor how much fluid is collecting in the drainage reservoir bulb. The amount of fluid collecting in the drainage reservoir bulb is an important indicator as to how much fluid the patient is absorbing. Often high fluid levels indicate that a patient may be hemorrhaging, whereas low fluid levels indicate that a patient may be experiencing a clot. If the drain assembly becomes loose and fluid spills from the drain bulb the patient's doctor or nurse may be unable to determine whether the patient is hemorrhaging or clotting.

Each and every other patent and patent application mentioned in this disclosure, to include U.S. Pat. Nos. 5,429,593; 5,643,233; 5,980,499; 6,032,289; 6,574,800; 7,010,812; 7,073,204; and 6,524,288, are incorporated in their entirety and for all purposes in the present patent application and this disclosure. Other U.S. patents have suggested approaches for supporting fluid drainage devices. These include U.S. Pat. No. 5,643,233, U.S. Pat. No. 5,429,593, U.S. Pat. No. 5,980,499, U.S. Pat. No. 6,524,288, and U.S. Pat. No. 5,429,593. While these devices do serve to support a fluid drainage assembly, the devices are meant for wear underneath clothing. The wearer must partially or completely disrobe to access the fluid drainage devices. In a hospital setting, it is important to facilitate access to the fluid drainage devices so that health care providers may rapidly and frequently assess a patient's fluid absorption. If the fluid drainage assembly is difficult to access, then there may be a risk that the fluid drainage assembly will be examined less frequently and changes in fluid absorption may go unnoticed.

Other U.S. patents, such as U.S. Pat. No. 7,010,812, suggest approaches for supporting fluid drainage devices on the outside of the garment. However, these devices only support the fluid drainage device near the wearer's breast region. It is important that the fluid drainage reservoir not be too elevated in comparison to the wearer's surgical site and drainage tubing. The elevated placement of the fluid drainage reservoir may inhibit the flow of fluid from the surgical site into the fluid drainage bulb. This decreases the efficacy of the medical drainage device and increases the risk of infection in the patient.

Other U.S. patents, such as U.S. Pat. No. 6,574,800, suggest approaches for supporting fluid drainage devices on the outside of the garment with lower fluid drainage device support. However, these devices are configured for home recovery and do not possess a pocket cloth which is partly fixed to the garment fabric and partly detachably coupled. Without a pocket that is partly detachably coupled to the garment fabric, the device does not provide the same ease of access to the medical drainage device that is important in a hospital setting. A partly detachably coupled pocket cloth facilitates ease of access to the drainage reservoir bulb so that the drainage reservoir bulb is more easily monitored and changed by the wearer or a healthcare provider.

Thus, it is found that the various techniques and configurations commonly employed for supporting a fluid drainage device fail to meet the needs of a patient in a hospital setting. There is therefore a long felt need to provide methods and systems that support the use of bodily fluid reservoirs. The present invention meets a long felt need for a garment that facilitates access to the fluid drainage device, and secures and supports the fluid drainage device which reduces, minimizes, or eliminates the risk of the fluid drainage device coming into contact with a non-sterile environment or spilling fluid.

SUMMARY OF THE INVENTION

Towards this object and other objects that will be made obvious in light of this disclosure, the method of the present invention provides a garment that supports the use of a bodily fluid reservoir. The present invention provides an improved drainage reservoir support garment which secures and supports drainage reservoirs and other fluid reservoir assemblies without the aid of pins or tape. The present invention is directed to a garment including a pocket cloth or set of pocket cloths attached to a fabric sheet. The pocket cloths may be attached to the fabric at locations close to or covering apertures in the fabric of the gown. The apertures may be large enough to receive drainage tubing approximately 1 cm thick and a drainage reservoir bulb approximately 10 cm in diameter and allow drainage tubing to be fed from the wearer's surgical area through the opening of the garment and into the interior of the pocket cloth securing the drainage reservoir or other fluid reservoir. The pocket cloths may be secured to the body of the garment in a manner which allows a portion of the pocket cloth to be partly fixed to the fabric, such as but not limited to partly sewing or gluing the pocket cloth to the fabric of the garment, and a portion of the pocket cloth to be detachably coupled to the fabric with at least one releasable fastener, such as but not limited to snaps, buttons, ties, hook and loop, and zippers. Thus, a portion of the pocket cloth may be in certain embodiments decoupled from the body, allowing for easier access to the a drainage bulb.

In certain preferred alternate embodiments, the pocket cloths are sufficient in size to accommodate a drainage reservoir bulb approximately 10 cm in diameter. The present invention facilitates access to the drainage reservoir assembly by allowing access to the assembly from the exterior of the garment in certain still alternate preferred embodiments. Because the pocket cloths are partly detachably coupled, a portion of the pocket cloth may rapidly and effortlessly be opened and the drainage reservoir assembly quickly examined or changed. In a hospital setting, the drainage reservoir assembly may need to be examined and changed frequently by the wearer or healthcare provider. Facilitating ease of access to the drainage reservoir assembly ensures that the drainage reservoir assemblies are frequently monitored which in turn minimizes risk of infection to the wearer.

Pocket cloths may be attached near both the wearer's chest region and the wearer's thigh region. Incisions may exist at either location on the wearer's body. By locating the pocket cloth lower on the garment near the wearer's thigh region, fluid from a lower incision site on the wearer's body does not need to travel upwards against gravity to an elevated location on the garment. This facilitates drainage and minimizes the risk of infection.

By securing and supporting fluid reservoirs with the pocket cloth rather than with pins or tape, the present invention reduces, minimizes, or eliminates the risk of the drainage assembly from coming into contact with a non-sterile environment. The present invention may also reduce, minimize, or eliminate the risk of fluid spilling from the drainage bulb.

Certain yet alternate preferred embodiments of the present invention are directed to a method of providing a garment having a pocket configured for securing a fluid reservoir, comprising a tubing aperture, the tubing aperture enabling placement and removal of the fluid reservoir through the interior side of the garment; coupling a fluid reservoir to a wearer's body; and placing the fluid reservoir through the tubing aperture, whereby a tubing extends through the tubing aperture.

DETAILED DESCRIPTION OF THE PREFERRED EMBODIMENTS

Figure 1:
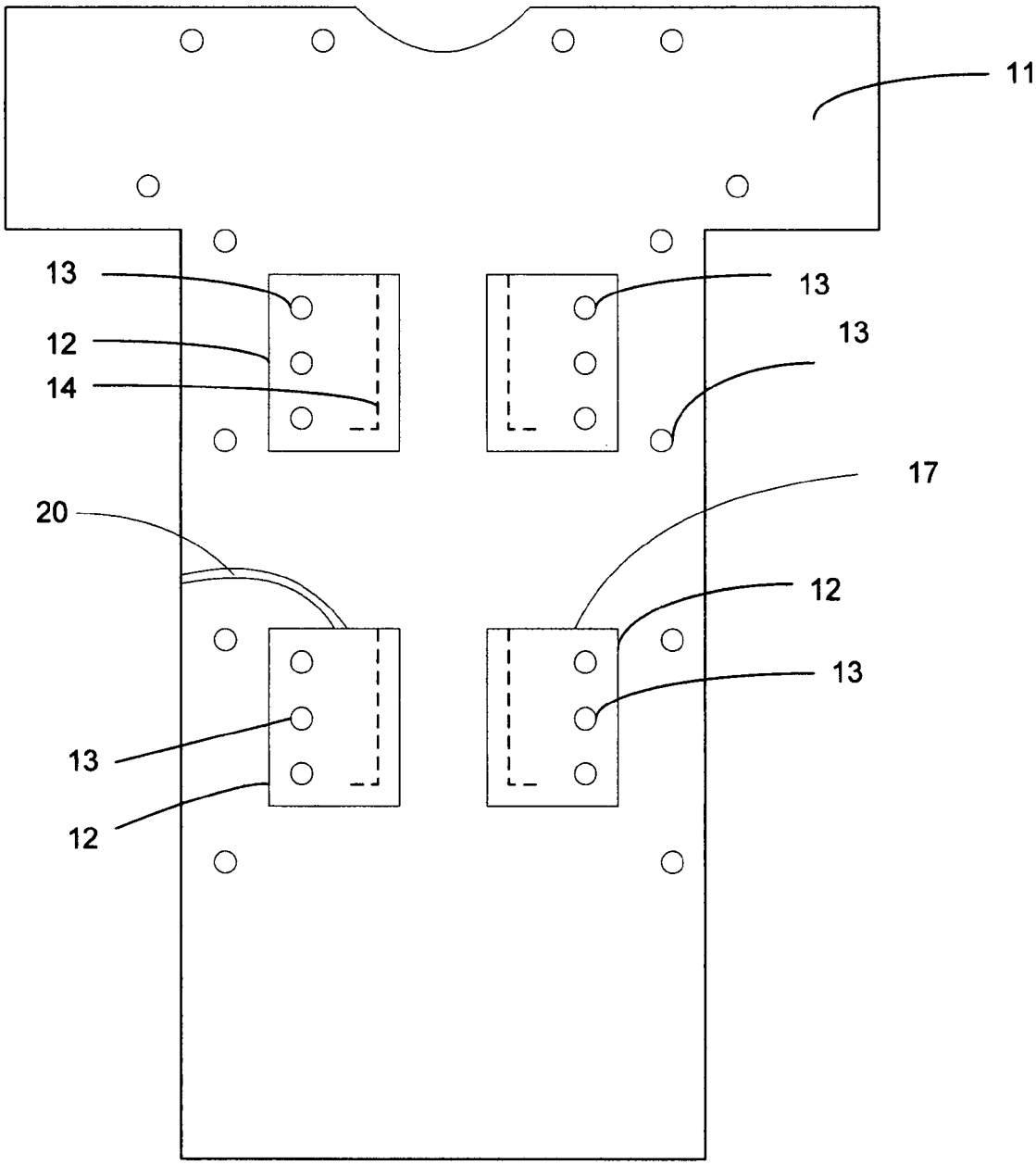
FIG. 1 is a perspective representation of the front view of the garment of the present invention showing a set of four pocket cloths for storing a drainage reservoir.

The accompanying drawings are referenced in conjunction with the detailed description so that the present invention may be more readily understood. The present invention provides a user wearable garment 10 capable of securing and storing drainage reservoirs for a post operative wearer.

The garment 10 comprises a fabric sheet with a front side 11 and a back side 16, a head opening and two arm openings. The body of the garment is large enough to loosely fit around a torso region of a wearer's body and extend to about the knee region of the wearer's body. The garment 10 is detachably coupled around the wearer's body so that the wearer may easily put on and remove the garment.

The pocket cloths 12 are attached to the fabric at locations close to or covering apertures 15 in the fabric of the gown. The apertures 15 are within a range of 0 cm to 15 cm and are large enough to receive drainage tubing approximately 1 cm thick and a drainage reservoir bulb approximately 10 cm in diameter and allow drainage tubing to be fed from the wearer's surgical area through the opening of the garment and into the interior of the pocket cloth 12 securing a drainage reservoir or other suitable fluid reservoir known in the art. The pocket cloths 12 are sufficient in size to accommodate a drainage reservoir bulb approximately 10 cm in diameter and the length and width of the pocket cloths 12 is within a range of 0 cm to 20 cm.

FIG. 1 shows a user wearable garment made of a fabric sheet. This embodiment shows the front side 11 of the garment. The garment has a head opening, two arm openings, and short sleeves. This embodiment uses releasable fasteners 13 at the top and sides to detachably couple the front side 11 of the garment to the back side 16 of the garment. Although these releasable fasteners 13 are shown as snaps, the releasable fasteners 13 utilized in the present invention could be any suitable releasable closing structures such as but not limited to snaps, buttons, ties, hook and loops, hook and eyes, buckles, and zippers. In this embodiment drainage tubing 20 runs in between a side aperture formed between two releasable fasteners detachably connecting the front side 11 of the garment and the back side 16 of the garment and into a pocket cloth 12.

In this embodiment, two pocket cloths 12 are located proximate to, e.g. within 20 cm of, the wearer's chest region and two pocket cloths 12 are located proximate to, e.g. within 20 cm of, the wearer's thigh region. Each pocket cloth 12 comprises a piece of material not more than 20 cm long and 20 cm wide sewn to the garment fabric along one side of the pocket cloth 12 and half way across the bottom of the pocket cloth 12. The pocket cloth 12 could be fixed to the fabric by means other than sewing. For example, the pocket cloth 12 could be partly fixed to the fabric using glue. Opposite the side of the pocket cloth 12 partly fixed to the fabric, the pocket cloth is detachably coupled to the fabric of the garment utilizing releasable fasteners 13. In the present embodiment, the releasable fasteners 13 are snaps. In this embodiment, drainage tubing is fed through an aperture between releasable fasteners 13 at the side of the garment and into the lower left pocket formed between the fabric and the pocket cloth 12. A top aperture 17 exists between the garment fabric and the pocket cloth 12.

Figure 2:
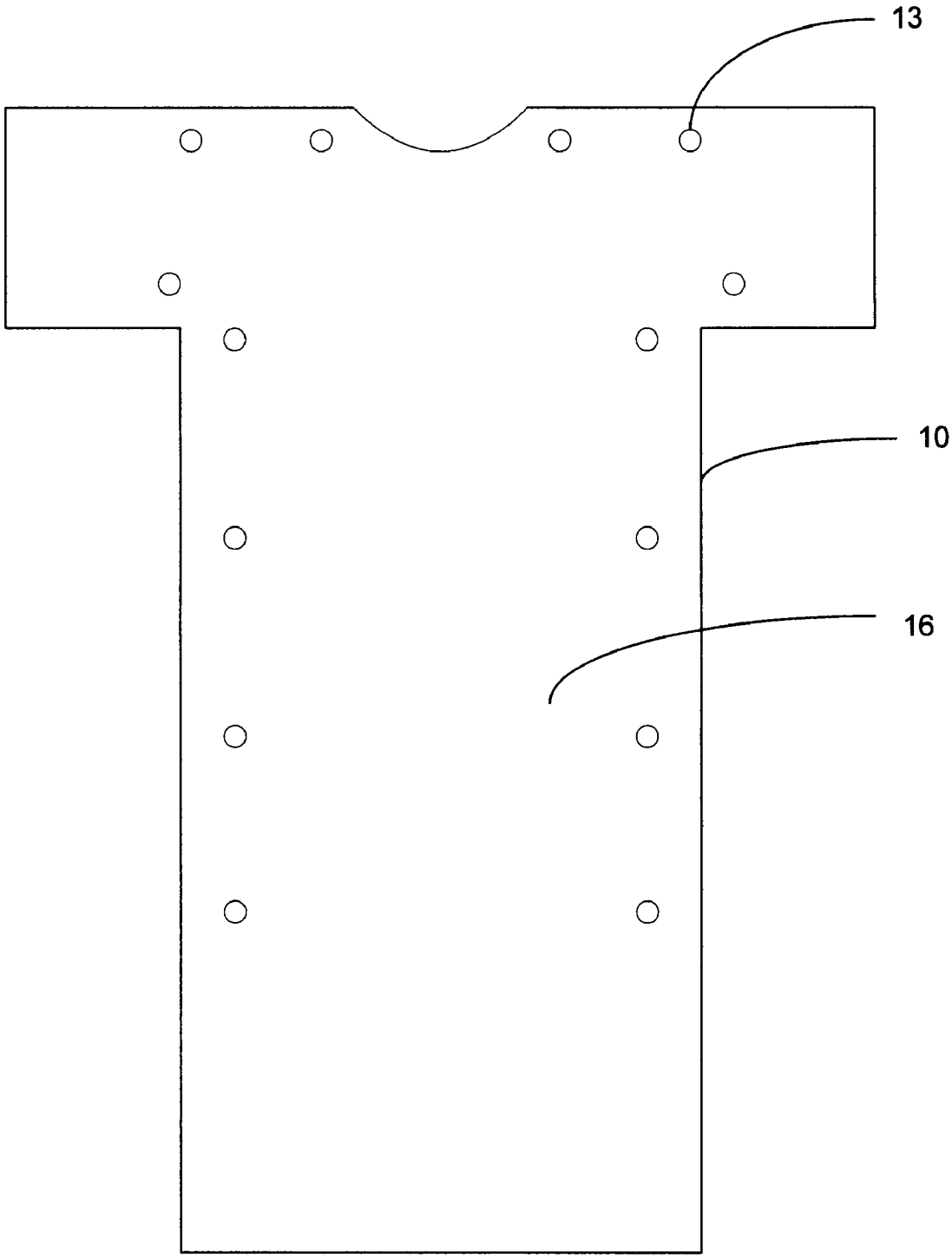
FIG. 2 is a perspective representation showing the back of the garment.

FIG. 2 shows the back side 16 of the garment. Releasable fasteners 13 are utilized to secure the front side 11 of the garment to the back side 16. Although these releasable fasteners 13 are shown as snaps, the releasable fasteners 13 utilized in the present invention could be any suitable releasable closing structures such as but not limited to the group consisting of snaps, buttons, ties, hook and loop, hook and eye, buckles, and zippers. The back side may be comprised of two separate panels including a left panel and a right panel detachably coupled together utilizing releasable fasteners, but this is not the preferred embodiment because the ties often become loose as the weight of the drainage reservoirs in the front increases.

Figure 3:
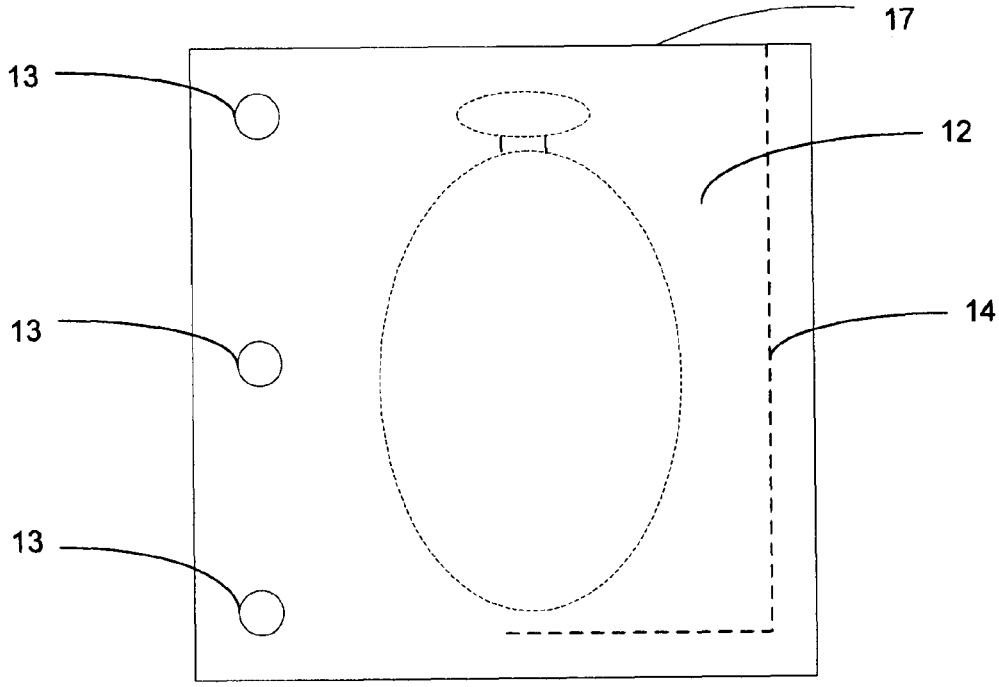
FIG. 3 is a perspective representation of the pocket cloth for storing a drainage reservoir, showing a portion of the pocket cloth sewn to the fabric of the garment and a portion of the pocket cloth detachably coupled to the fabric of the garment with releasable fasteners (e.g. snaps, buttons, ties, hook and loop, hook and eye, buckles, and zippers)

FIG. 3 is a closer perspective view of the pocket cloth 12 in the closed position. The pocket cloth 12 is partly fixed 14 to the garment by sewing along one side of the pocket cloth 12 and half way across the bottom of the pocket cloth 12. The opposite side of the pocket cloth is detachably coupled to the garment fabric utilizing releasable fasteners 13. This embodiment utilizes snaps, but any suitable releasable closing structures could be used such as but not limited the group consisting of snaps, buttons, ties, hook and loop, hook and eye, buckles, and zippers. A top aperture 17 exists between the garment fabric and the pocket cloth 12.

Figure 4:
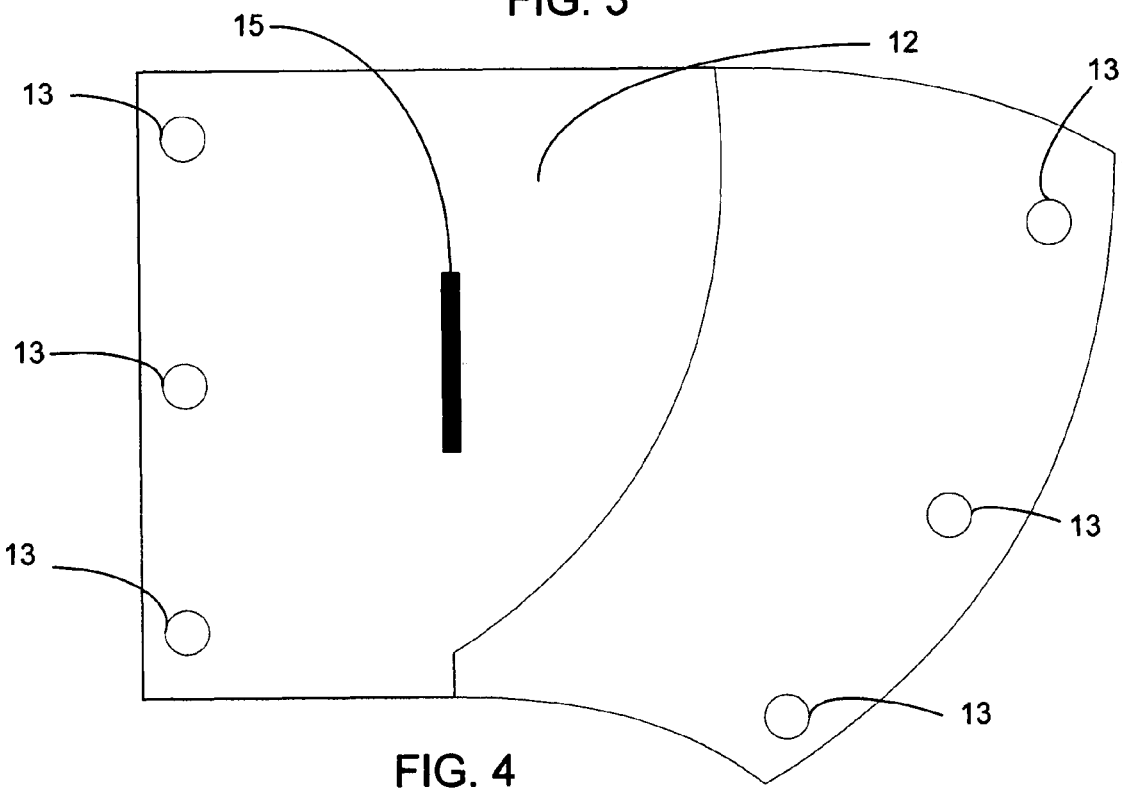
FIG. 4 is a perspective representation of the pocket cloth for storing a drainage reservoir showing the open pocket cloth and showing an aperture in the fabric of the garment which the pocket cloth had been covering.

FIG. 4 shows a closer perspective view of the pocket cloth 12 in the open position. The pocket cloth 12 is partly fixed 14 to the fabric by sewing along one side of the pocket cloth 12 and half way across the bottom of the pocket cloth. Releasable fasteners 13 are shown along one side of the pocket cloth 12 and along the corresponding side of the garment fabric at an attachment site. An aperture 15 in the garment fabric allows drainage tubing to travel from the wearer's surgical site through the aperture 15 and into the pocket formed between the fabric of the garment and the pocket cloth 12 where the drainage reservoir bulb is stored. This embodiment shows the aperture 15 in the fabric of the garment underneath the pocket cloth, but the aperture 15 could be located proximate to the pocket cloth 12 such as but not limited to directly above the pocket cloth 12. The aperture 15 in the fabric is between 0.5 cm and 12.0 cm in length.

Figure 5:
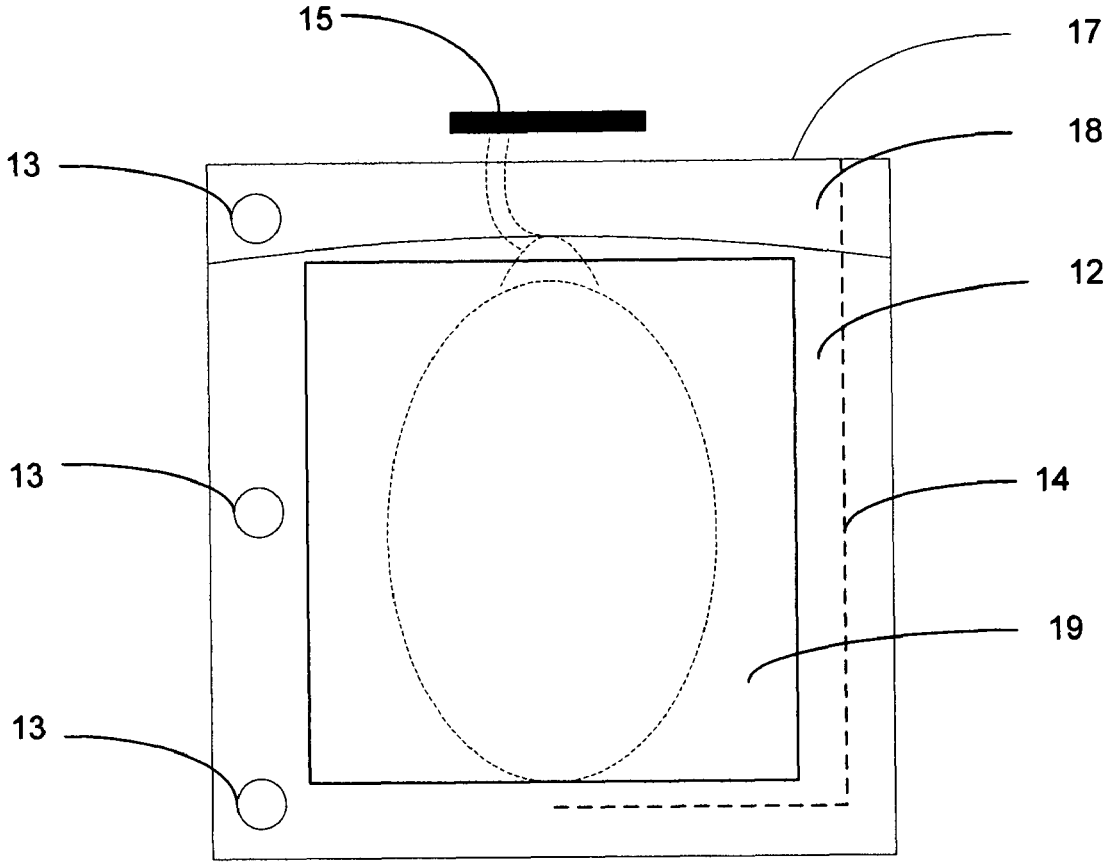
FIG. 5 is a perspective representation showing the pocket cloth and showing an aperture in the fabric of the garment which is positioned above the pocket.

FIG. 5 shows a closer perspective view of the pocket cloth 12 in the closed position. In this embodiment the pocket cloth 12 is partly fixed 14 to the garment fabric by sewing along one side of the pocket cloth 12 and half way across the bottom of the pocket cloth. The opposite side of the pocket cloth is detachably coupled to the garment fabric utilizing releasable fasteners 13. The aperture 15 in the garment fabric is located directly above the pocket cloth 12. The drainage tubing for the drainage reservoir assembly extends from the wearer's body though the aperture and down into the pocket formed between the garment fabric and the pocket cloth 12 to the drainage reservoir bulb. A top aperture 17 exists between the garment fabric and the pocket cloth 12. An insertable rigid shield 19 surrounds the drainage reservoir bulb. An elastic material 18 forms the top of the pocket cloth 12 so that the top portion of the pocket cloth 12 may retract more than the bottom portion of the pocket cloth 12.

The garment is constructed of a breathable material utilizing but not limited to cotton or fabric blend material. In one preferred embodiment, the garment may be constructed of material comprising 55% cotton and 45% polyester. The fabric must provide the necessary support to hold a full drainage reservoir bulb.

While the invention has been described with reference to preferred and example embodiments, other variations and modifications within the scope of the invention will become apparent to those of skill in the art. Such variations are included within the spirit and scope of this invention as defined by the following claims.

The invention claimed is:

1. A garment, comprising:

a fabric sheet having a front side and a back side; and at least one pocket cloth, the pocket cloth partly fixed to the front side of the fabric sheet along one side of the pocket cloth and half way across a bottom of the pocket cloth and party detachably coupled to the front side of the fabric sheet and configured to create a pocket that secures and supports a medical drainage reservoir; and a tubing aperture in the fabric sheet, the tubing aperture configured to receive a medical tubing and enable the medical tubing to deliver fluid to the medical drainage reservoir while secured by the pocket cloth whereby the tubing aperture is concealed in whole or in part by the at least one pocket cloth or is located directly above said pocket cloth wherein the medical tubing is wholly or in part hidden from view.

2. The garment of claim 1, wherein said garment is a gown having a head aperture and two arm apertures.

3. The garment of claim 1, further comprising at least one releasable fastener, configured to enable at least partial decoupling of the pocket cloth and the fabric.

4. The garment of claim 3, further comprising said at least one releasable fastener, configured to enable complete decoupling of the pocket cloth and the fabric.

5. The garment of claim 3, wherein the releasable fastener is comprising an element selected from the group consisting of snaps, buttons, ties, hook and eye, buckles, and zippers.

6. The garment of, claim 1, comprising at least one additional pocket cloth to enable insertion of a drainage reservoir.

7. The garment of claim 1, comprising a pocket cloth wherein elastic material forms the top of said pocket cloth so that the opening of the created pocket retracts.

8. The garment of claim 1, comprising a pocket cloth configured to secure and store an ovular bulb drainage reservoir with a mass of up to approximately one kilogram.

9. The garment of claim 1, comprising an insertable rigid shield.

10. The garment of claim 1, wherein the pocket cloth is coupled to the fabric proximate to the wearer's chest region.

11. The garment of claim 1, wherein the pocket cloth is coupled to the fabric proximate to the wearer's thigh region.

12. A method, comprising:

a. providing a garment for use in a hospital, the garment having a partly fixed and partly detachable pocket cloth configured for securing a fluid reservoir, said pocket cloth partly fixed to the front side of the garment along one side of the pocket cloth and half way across a bottom of the pocket cloth; and further comprising a tubing aperture, the tubing aperture enabling placement and removal of the fluid reservoir through the interior side of the garment;

b. coupling a fluid reservoir to a wearer's body;

c. placing the fluid reservoir through the tubing aperture, whereby a tubing extends through the tubing aperture, and either concealing the tubing aperture and tubing in whole or in part by the pocket, or limiting tubing visibility by locating the tubing aperture directly above said pocket wherein the medical tubing is wholly or in part hidden from view.

* * * * *